US005243932A

United States Patent [19]

Herrmann

[11] Patent Number: 5,243,932

[45] Date of Patent: Sep. 14, 1993

[54] PILOT/MAIN FUEL INJECTION METHOD FOR DIESEL ENGINES

[75] Inventor: Robert Herrmann, Le Chesnay, France

[73] Assignee: S.E.M.T. Pielstick, Saint-Denis, France

[21] Appl. No.: 866,516

[22] Filed: Apr. 10, 1992

[30] Foreign Application Priority Data

Apr. 12, 1991 [FR] France ..... 91 04514

[51] Int. Cl.[5] ..... F02B 47/00; F02B 3/00; F02M 21/02; F02M 43/00

[52] U.S. Cl. ..... 123/25 E; 123/27 GE; 123/304; 123/575; 123/526

[58] Field of Search ..... 123/304, 299, 575, 252, 123/25 E, 27 GE, 526

[56] References Cited

U.S. PATENT DOCUMENTS

| | | | |
|---|---|---|---|
| 4,403,944 | 9/1983 | Pyykkonen | 123/25 E |
| 4,597,671 | 7/1986 | Marelli | 123/25 E |
| 4,619,240 | 10/1986 | Bedford et al. | 123/304 |
| 4,641,625 | 2/1987 | Smith | 123/304 |
| 4,705,010 | 11/1987 | Baranescu | 123/575 |
| 4,732,114 | 3/1988 | Binder et al. | 123/25 E |
| 4,831,993 | 5/1989 | Kelgard | 123/575 |
| 4,831,993 | 5/1989 | Kelgard | 123/27 GE |
| 4,834,055 | 5/1989 | Steiger | 123/575 |
| 4,924,822 | 5/1990 | Asai et al. | 123/304 |
| 4,955,326 | 9/1990 | Helmich | 123/27 GE |
| 5,024,195 | 6/1991 | Pien | 123/304 |
| 5,136,986 | 8/1992 | Jensen | 123/27 GE |
| 5,140,959 | 8/1992 | Durbin | 123/304 |

FOREIGN PATENT DOCUMENTS

| | | |
|---|---|---|
| 0027682 | 4/1981 | European Pat. Off. . |
| 0237071 | 9/1987 | European Pat. Off. . |
| 2383315 | 10/1978 | France . |

OTHER PUBLICATIONS

Patent Abstracts of Japan, vol. 11, No. 316 (M-631) (2763) Oct. 15, 1987, & JP-A-62 99667 (Mazda) May 9, 1987.

*Primary Examiner*—Willis R. Wolfe
*Assistant Examiner*—Thomas N. Moulis
*Attorney, Agent, or Firm*—Sughrue, Mion, Zinn, Macpeak & Seas

[57] ABSTRACT

A fuel injection method for diesel internal combustion engines uses main injection of a gas main fuel and pilot injection of a liquid secondary fuel to initialize combustion of the main fuel. The liquid fuel is injected by an injector pump designed to enable the engine to achieve its maximum power with the liquid fuel only. The pilot injection comprises a mixture of water and liquid fuel.

2 Claims, No Drawings

PILOT/MAIN FUEL INJECTION METHOD FOR DIESEL ENGINES

BACKGROUND OF THE INVENTION

1. Field of the invention

The present invention concerns a fuel injection method for diesel internal combustion engines using main injection of a gas main fuel and pilot injection of a liquid secondary fuel which initializes combustion of the main fuel. This is known as dual fuel injection.

2. Description of the prior art

The prior art injection method for dual fuel diesel engines which operate with two fuels, one a gas and the other a liquid, is to initialize the combustion of the main fuel (the gas) by injecting a liquid fuel representing 5 to 10% of the maximum volume that can be injected by the injector pump. The injector pump is designed to enable the engine to achieve its maximum power from the liquid fuel only, in the temporary absence of the gas fuel.

The minimum volume of liquid fuel injected is limited by the geometrical precision with which the injector pump and injector components are manufactured. This precision determines the lower limit below which it is no longer possible to guarantee a balance between the cylinders and the regular injection of a sufficient volume to initialize combustion (approximately equivalent to 2% of the maximum energy input). The minimum volume of liquid fuel injected is further limited by the dimensions of the holes of the injector atomizer which are optimized for correct atomization at full engine power. They are then too large to atomize properly a few percent of the maximum flowrate.

Experience shows that reducing the volume of the pilot injection reduces exhaust carbon monoxide and nitrogen oxides. What is more, the high cost of the liquid fuel is an incentive to reducing its use.

The present invention proposes to reduce the liquid fuel pilot injection volume to the thermodynamically sufficient minimum independently of the precision with which the injector pump is manufactured and independently of the dimensions of the atomizer holes. This can be achieved by mixing water with the liquid fuel.

SUMMARY OF THE INVENTION

The invention consists in a fuel injection method for diesel internal combustion engines using main injection of a gas main fuel and pilot injection of a liquid secondary fuel to initialize combustion of the main fuel, the liquid fuel being injected by an injector pump designed to enable the engine to achieve its maximum power with the liquid fuel only, in which method the pilot injection comprises a mixture of water and liquid fuel.

The invention will be better understood and other advantages will emerge from the following description given by way of non-limiting example.

DETAILED DESCRIPTION OF THE INVENTION

Duel fuel engines usually employ one injector pump for the liquid fuel for each cylinder of the engine, each cylinder having its own injector. Gas is fed into a cylinder through its own distribution system.

In an engine of this type the liquid fuel is injected by an injector pump designed to enable the engine to achieve its maximum power from the liquid fuel only.

Mixing water with the liquid fuel in proportions enabling the pilot injection to initialize combustion solves the problem of the regularity of the volume injected by the pump because the volume of mixture injected by the pump becomes reasonable (between 5 and 10% of the maximum volume that can be injected by the pump, for example). Much better atomization in the injector is also achieved.

An advantage of the invention is that no modification is required to the engine, the fuel-water mixture being prepared outside the engine by a known method.

The volume of liquid fuel contained in the mixture can be reduced to the thermodynamically necessary minimum volume compatible with the precision of the injector pump and the dimensions of the injector atomizer holes. This minimum volume is easily determined by experiment.

A volume of liquid fuel in the mixture representing 2% to 7% of the maximum volume that can be injected by the pump is entirely satisfactory for correct operation of the engine.

The volume of the pilot injection, that is to say the quantity of mixture injected, may then represent between 5 and 10% of the maximum volume that can be injected by the pump.

I claim:

1. Fuel injection method for a diesel internal combustion engine comprising effecting a main injection of a gas main fuel simultaneously with a pilot injection of a liquid secondary fuel to initialize combustion of the main fuel, wherein the liquid fuel is effected via an injector pump designed to enable the engine to achieve its maximum power with the liquid fuel only, wherein the step of pilot injection comprises the injection of a mixture of water and liquid fuel having a volume of liquid fuel contained in the mixture which is the thermodynamically necessary minimum volume compatible with precision of the injector pump and dimensions of the injector atomizer holes and wherein the volume of liquid fuel of the mixture in the pilot injection is in the range of 5 to 10% of the maximum volume that can be injected by the pump.

2. Method according to claim 1 wherein the volume of the liquid fuel in the pilot injection is more preferably in the range 2% to 7% of the maximum volume that can be injected by the pump.

* * * * *